United States Patent [19]

Dietrich et al.

[11] 4,120,225

[45] Oct. 17, 1978

[54] METHOD AND APPARATUS FOR AUTOMATICALLY PRODUCING IN AN ELECTRONIC ORGAN RHYTHMIC ACCOMPANIMENT MANUAL NOTE PATTERNS

[75] Inventors: Ralph Nowack Dietrich; John William Robinson, both of Jasper, Ind.

[73] Assignee: Kimball International, Inc., Jasper, Ind.

[21] Appl. No.: 759,908

[22] Filed: Jan. 17, 1977

[51] Int. Cl.[2] ..... G10H 1/00

[52] U.S. Cl. ..... 84/1.03; 84/DIG. 22

[58] Field of Search ..... 84/1.01, 1.03, 1.17, 84/1.24, DIG. 12, DIG. 22, DIG. 25

[56] References Cited

U.S. PATENT DOCUMENTS

| | | | |
|---|---|---|---|
| 3,546,355 | 12/1970 | Maynard | 84/1.03 |
| 3,548,066 | 12/1970 | Freeman | 84/1.03 |
| 3,842,184 | 10/1974 | Kniepkamp et al. | 84/1.01 |
| 3,918,341 | 11/1975 | Bunger | 84/1.01 |
| 3,954,038 | 5/1976 | Adams | 84/1.01 |
| 3,990,339 | 11/1976 | Robinson et al. | 84/1.17 |
| 4,020,728 | 5/1977 | Robinson et al. | 84/1.03 |

*Primary Examiner*—Robert K. Schaffer
*Assistant Examiner*—Vit W. Miska
*Attorney, Agent, or Firm*—Albert L. Jeffers; John F. Hoffman

[57] ABSTRACT

An electronic organ in which rhythmic note patterns can be played on the accompaniment manual by the depression of a single key. The organ includes a source of rhythmic pulses which may, for example, be taken from the pulse source of a conventional rhythm unit. The accompaniment manual of the organ can be played in a conventional manner or it can be adjusted to play rhythmic note patterns during which the normal playing of the accompaniment manual is disabled and only a selected group of accompaniment keys, preferably a group of adjacent keys at the left end of the keyboard, are enabled for controlling the pattern to be played. When the organ is adjusted for pattern playing, each of the aforementioned group of keys is operable, when depressed, to initiate the playing of a pattern in conformity with stored memories and in further conformity with the respective one of the pattern controlling keys which is depressed.

19 Claims, 14 Drawing Figures

12
18
20
22
24
47
46
C1
C#
D1
D#
D2
0
1
2
3
4
5
6
7
E1
C1
b1
a1
G5
E0
C2
b2
a2
+V
10 1Q
20 2Q
30 3Q
40 4Q
LATCH
A
B
C
D
1 OF 16
ROOT OF PATTERN R.O.M.
K
VCC
14
M
TO LATCH 52
8
NKD

34
RHYTHM UNIT
28
30
32
36
38
A
B
C
D
C0
C1
38A
38B
PATTERN R.O.M.
40
J
48
PATT. 1
PATT. 2
PATT. 3
R.O.M. 24 & INVERTER 46
50
L
70
72
74
PATT. 1
PATT. 2
PATT. 3
+V
44
42

40
PATTERN R.O.M.
FLATTING R.O.M.
41

FLAT COMMANDS
43
49
48
26
47
52
ONE BIT ADDER
(ADD 1 FOR FLATTING A NOTE)
A.L.U.
6 BIT LATCH
50
MAJ.
MIN.
DIM.
ROOT OF PATTERNS R.O.M. PLUS MAJOR MINOR SEVENTH CHORDS
24
45

22
ONE OF 16 DECODE
202
4 BIT LATCH
CK
CNT 62

206
HF CLOCK
4 BIT COUNTER
200
CK
PRESET (1111)
CNT 63
LOGIC '0' PULSE ON KEY BEFORE CHORD PLAYING KEYS
S
RESET OFF=1 ON=0
208
MPX DATA
R
Q
1/2 CLOCK DELAY

METHOD AND APPARATUS FOR AUTOMATICALLY PRODUCING IN AN ELECTRONIC ORGAN RHYTHMIC ACCOMPANIMENT MANUAL NOTE PATTERNS

The present invention relates to electronic organs and is particularly concerned with a method and apparatus for the developing of rhythmic note patterns automatically in the accompaniment manual of the organ.

Most players are more adept in the use of the right hand than in the use of the left hand, the latter being used primarily in connection with the accompaniment manual. For simple compositions, the scoring in the accompaniment manual is relatively simple and can be accomplished by the ordinary non-professional, or non-expert, player.

Even relatively simple note patterns can be executed by the ordinary player, provided no complex timing is involved. The more complex patterns for the accompaniment manual, and which often involve complex timing or rhythm patterns, are quite often beyond the range of skill of the ordinary player and can only be executed by experts and professionals.

The present invention has as a primary objective the provision of circuitry for use in an electric organ which will enable ordinary players to produce complex and varied rhythmic note patterns in the accompaniment manual.

BRIEF SUMMARY OF THE INVENTION

According to the present invention, an organ can be constructed to operate in a conventional manner with the exception that the accompaniment manual is multiplexed. Multiplexing of the accompaniment manual is accomplished in the conventional manner by addressing the keys sequentially and establishing a data stream consisting of a data bit corresponding to each key in a respective time slot of the data stream and with each said bit being either "high" or "low" depending on whether the respective key is depressed or released.

Such a data stream, upon demultiplexing, is operable for actuating keyers which key tone signals derived from a tone generator, with the keyed tone signals being routed through voicing circuits and amplifier means to speaker means.

According to the present invention, the organ can be adjusted for playing rhythmic note patterns automatically in the accompaniment manual by interrupting the data stream from the accompaniment manual and, instead, enabling a group of keys of the accompaniment manual for controlling the playing of the rhythmic note patterns. The group of keys, preferably, a group of adjacent keys at the left end of the accompaniment manual, are referred to as "pattern control keys" and, when depressed, address one of a pair of read only memories.

The other read only memory of the pair is addressed by pulses derived, for example, from the pulse generating section of a conventional rhythm unit accompanying, or embodied in, the organ. The outputs of the read only memories are processed and control the supply of signals in the form of data bits in respective time slots to the data stream pertaining to the demultiplexer for the accompaniment manual and the rhythmic note patterns referred to are thereby established.

It will be understood that the accompaniment manual referred to may be an independent keyboard, or it may be the left hand portion of a single keyboard. Further, any keyboard, solo, accompaniment, or pedal can be used with the present invention.

The exact nature of the present invention will become more apparent upon reference to the following detailed description, taken together with the accompanying drawings, in which.

DETAILED DESCRIPTION OF THE INVENTION

Figure 1:
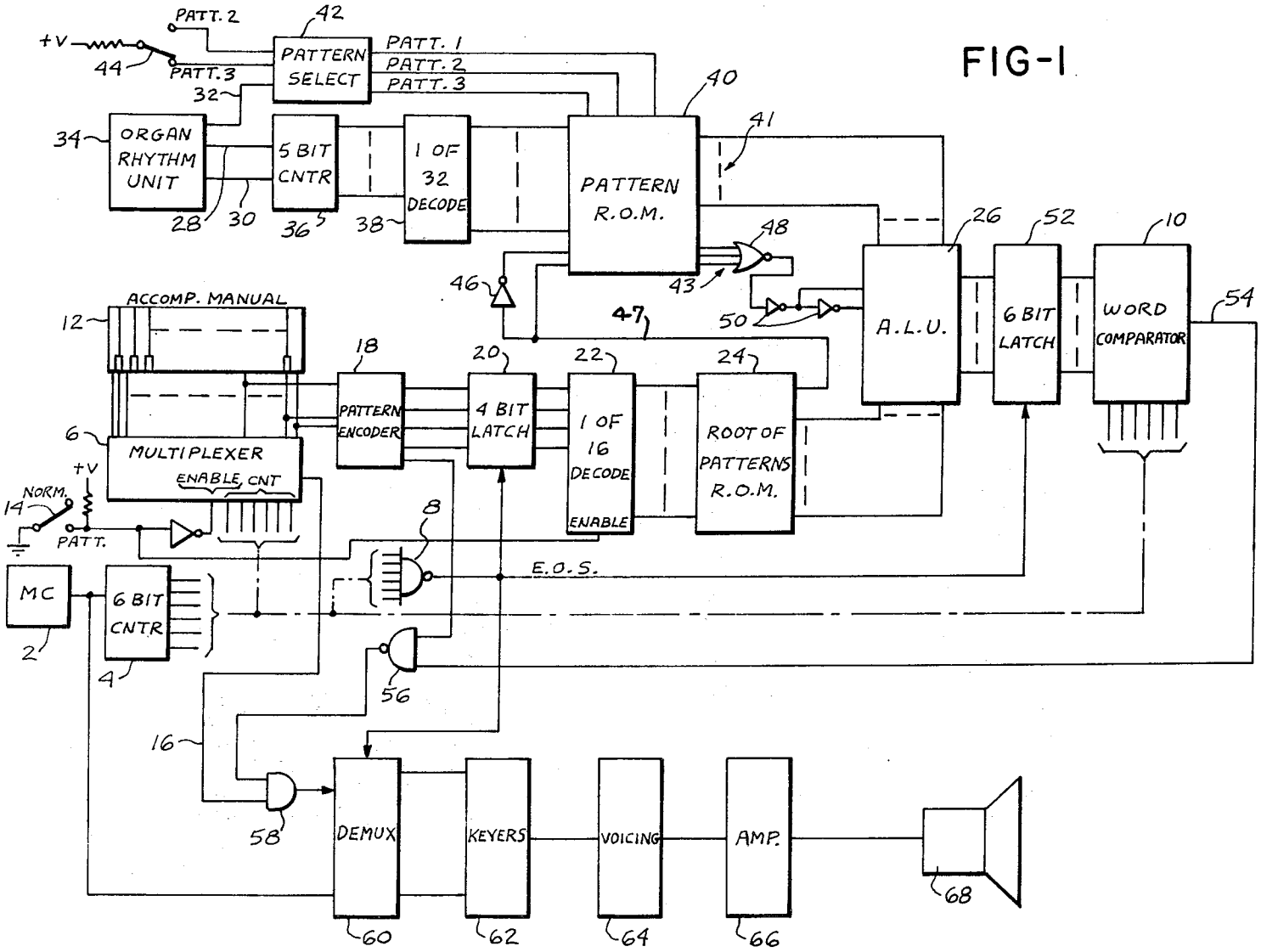
FIG. 1 is a simplified block diagram of a portion of an organ circuit embodying the circuit of the present invention.

Referring to FIG. 1, a master clock 2, which may run at 150 kilohertz, for example, drives a six bit counter 4. The output of counter 4 is used as the addressing input to a keyboard multiplexer 6 which scans accompaniment keyboard 12, and end-of-scan EOS decoder 8, and as one input word to a magnitude comparator 10. The multiplexing of keyboard 12 is conventional and is not described herein in detail.

As is known in the art, when keyboard 12 is scanned, a data stream is generated consisting of a data bit or item for each key of the keyboard disposed in a respective time slot in the data stream and with the voltage level of each data bit indicating whether or not the respective key of the keyboard is depressed. Usually, when a depressed key is scanned, the voltage level of the data stream goes low.

Multiplexer 6 is effective to multiplex accompaniment manual 12 when a selector switch 14 is in the "normal" position connected to voltage source Vcc. When switch 14 is in the "normal" position, multiplexer 6 outputs data on line 16 in the form, as mentioned, of time displaced bits or items, with each bit representing one key on the accompaniment manual 12 and with each bit being "high" or "low", depending on whether the respective key is released or depressed. Wire 16 is connected to one input of AND gate 58. Any key down signals occurring on wire 16 will be effective to pulse the output of AND gate 58 and will then be received by demultiplexer 60. Demultiplexer 60 is synchronized with multiplexer 6 by the output of master clock 2 and EOS circuit 8.

When switch 14 is in the second "pattern" position and connected to ground, the output of multiplexer 6 will be disabled with the output staying at the level of no-key depressed and, instead, a one of sixteen decoder 22 will be enabled. Pattern encoding circuit 18 is operative to encode the signal developed by the depressing of any one of a selected group of, preferably adjacent, keys of the accompaniment manual, hereinafter referred to as "pattern control" keys, into a four bit binary word called the pattern word.

The encoding circuit 18 is a priority encoder, so that, if more than one of the pattern control keys are depressed, the signal which is encoded is the signal from the key farthest to the right. The selected group of keys are, advantageously, a group of adjacent keys at the left end of the accompaniment manual.

End of scan decoder 8 is a NAND gate which develops a pulse at the end of each scan of the accompaniment manual. The signal produced by decoder 8 is derived from counter 4 on that count which corresponds to, or follows, the count on which the last key of the keyboard 12 is addressed during a scanning operation.

The end of scan pulse from decoder 8 clocks latch 20, which is supplied by encoding circuit 18, and latch 20 will then hold the four bit pattern word from encoding circuit 18 until it is again clocked at the next end of scan pulse and at which time a new word may be inserted therein.

The output of latch 20 is used as an addressing input to one of sixteen decoder 22. One of the sixteen output lines of decoder 22 will be enabled for each four bit pattern word supplied to the input thereof from latch 20, whenever selector switch 14 is in the "patterns" position; while none of the outputs of decoder 22 will be enabled when selector switch 14 is in the "normal" position. Each of the sixteen output lines from decoder 22 is connected to control one line of a read only memory 24, called the "root of pattern" read only memory.

The "root of pattern" read only memory 24 has a first output consisting of six output lines, and a second output consisting of a single output line to be described hereinafter, and develops a respective six bit binary word at the first output upon the supply of an enabling signal from decoder 22 to one of the sixteen lines forming the inputs to memory 24. The six bit word thus derived from memory 24 is used as one input word to an arithmetic logic unit (ALU) 26 operating, in this case, only as an adder or subtractor. As with the output of counter 4, each six bit word from read only memory 24 is the binary encoded equivalent of a respective key on the accompaniment manual as established for routine multiplexing.

The word at the output of read only memory 24 corresponds to a reference note for establishing the location of the pattern on the keyboard.

Further inputs to the circuit of the present invention are rhythm clock pulses on wire 28, rhythm count "one" decode pulse on wire 30, and rhythm clock $\frac{3}{4}$–4/4 time select command on wire 32, each derived from a standard organ rhythm unit schematically illustrated at 34. Rhythm clock pulses on wire 28 clock a five bit counter 36, while the count "one" decode pulse on wire 30 clears counter 36 to zero at each count "one" decode pulse.

The five wires forming the output of five bit counter 36 form the addressing input to a one-of-thirty-two decoder 38. A single one of the thirty-two outputs of decoder 38 is enabled for each binary word input to the decoder from counter 36. Each output of decoder 38 is connected to control one line of a second read only memory 40 referred to as the "patterns" read only memory. "Patterns" read only memory 40 consists of three major portions, or sections, with each portion, or section being selectively enabled by means of a selector circuit 42. It will be appreciated that the total possible number of patterns that can be programmed is virtually without limit.

Pattern selector circuit 42 will enable a first section of "patterns" read only memory 40 whenever the rhythm clock select command on wire 32 calls for the three-fourth time clock train. When the rhythm clock command on wire 32 calls for the four-fourth time clock train, pattern select circuit 42 will enable either a second or a third section of read only memory 40, depending on the position of pattern select switch 44.

The second output of "root of pattern" read only memory 24 enables one of two further output lines in "patterns" read only memory 40 via wire 47 and inverter 46 to supply a major or minor command to ready only memory 40. Once a section of "patterns" read only memory 40 has been enabled and one of the thirty-two outputs of decoder 38 is enabled, "patterns" read only memory 40 will develop one six bit output and one three bit output, as indicated in FIG. 1 at 41 and 43, respectively.

The six bit output from read only memory 40 forms a second input to ALU 26, while the three bit output forms the input to a NOR gate 48. The output of NOR gate 48, through inverters 50, forms a two line input to ALU 26. This two line input causes ALU 26 either to add or to subtract the six bit word from read only memory 40 to or from the six bit word from read only memory 24.

ALU 26 outputs a six bit word to latch 52. Latch 52 is clocked at the end of each scan from eos decoder 8, causing the latch 52 to hold the six bit word output of ALU 26 from one end-of-scan to the next.

The output of latch 52 is used as a second input to the aforementioned magnitude comparator 10. Magnitude comparator 10 supplies a pulse to the single line output 54 whenever the input word from latch 52 is equal to the input word from the six bit counter 4. This pulse is then supplied via NAND gate 56 and AND gate 58 to demultiplexer 60.

The output of AND gate 58 will be processed by demultiplexer 60, keyers 62, voicing and amplifying circuits and speakers 64, 66 and 68 in a conventional manner to produce tones.

Figure 2:
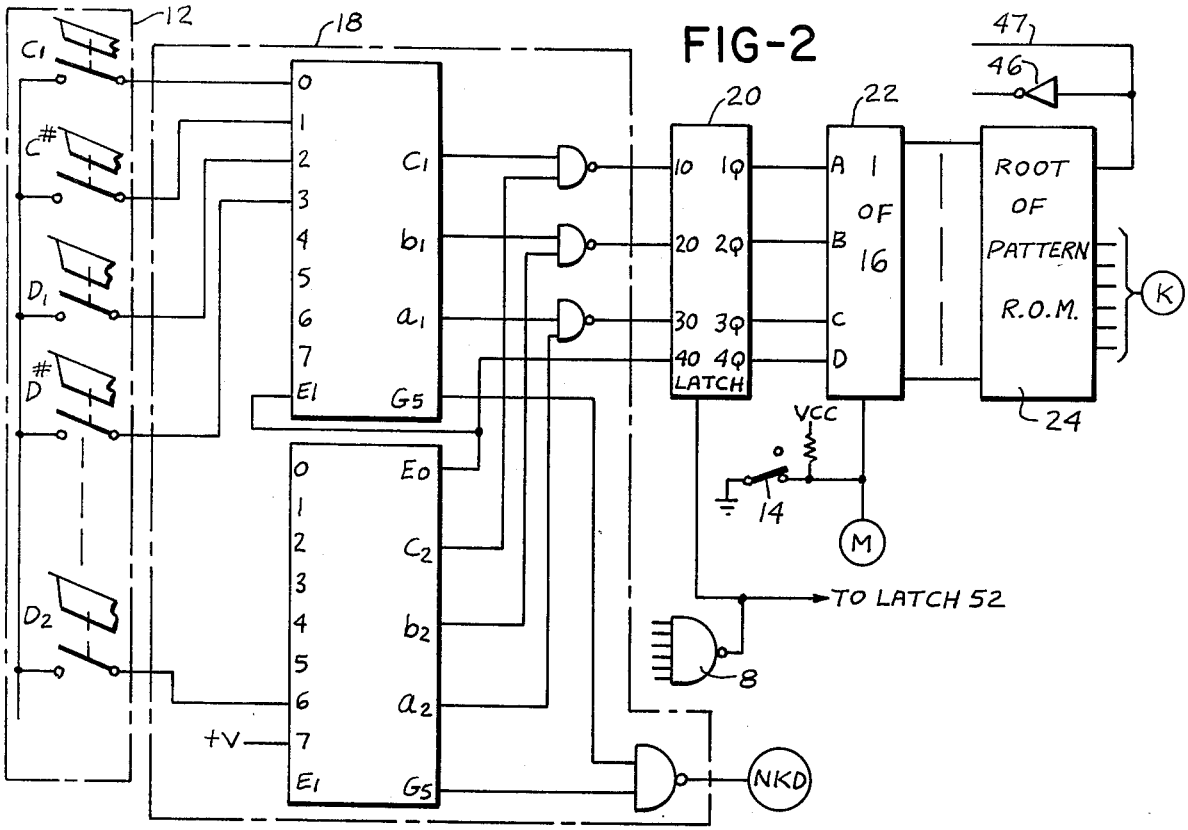
FIGS. 2, 3 and 4 are schematic diagrams of portions of the circuit of the present invention.
Figure 3:
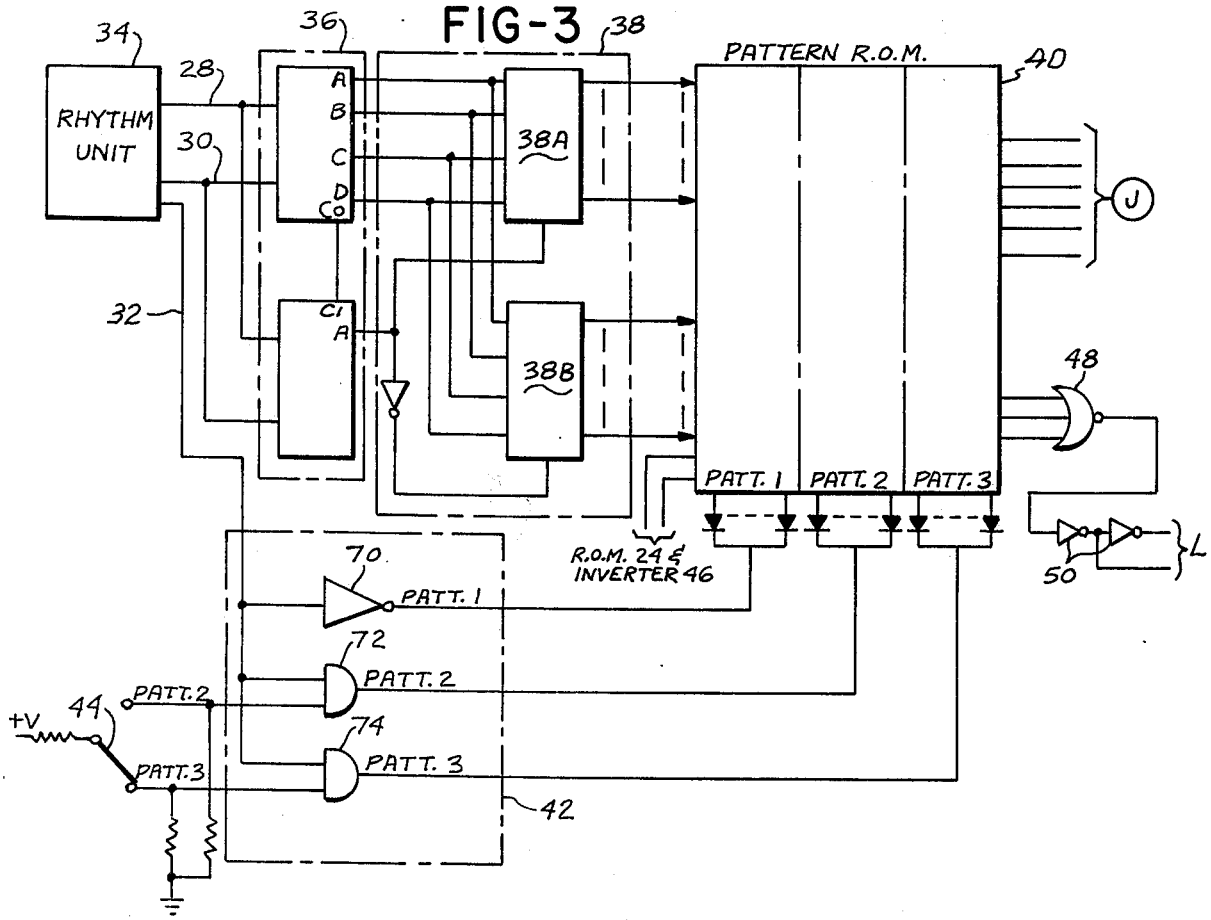
Figure 4:
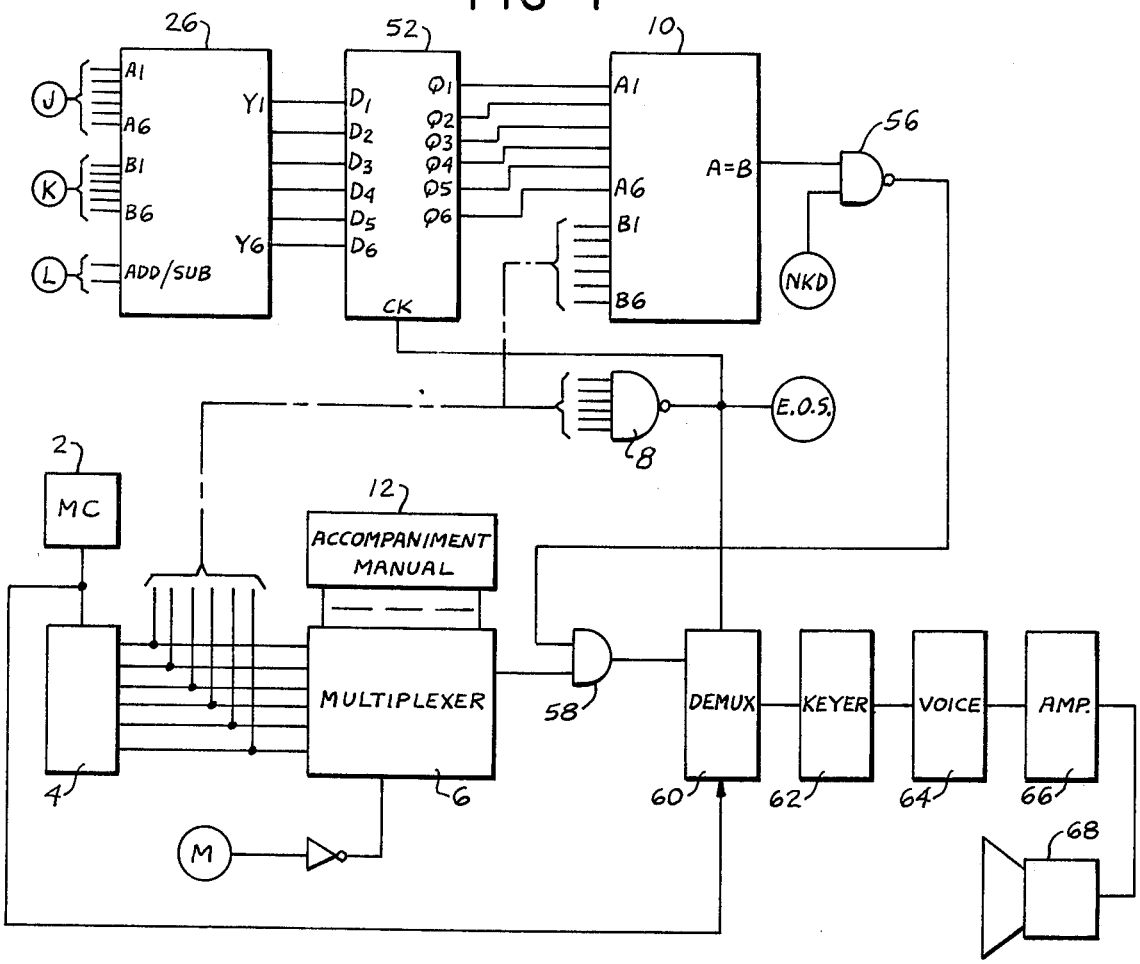

The circuit of the present invention is illustrated in somewhat greater detail in FIGS. 2, 3 and 4.

Referring to FIG. 2, the selected group of the previously referred to fifteen pattern control keys on the accompaniment manual 12 are connected to the inputs of two eight line to three line priority encoders, as shown within the dotted line marked 18, with the encoders interconnected to form a single fifteen line to four line priority encoder, with a second output indicated in FIG. 2 at NKD, and which supplies a logic zero signal whenever none of the pattern control keys in accompaniment manual 12 are depressed. The NKD output of pattern encoding circuit 18 is connected to one input of a NAND gate 56 (FIG. 1) and will be discussed in more detail hereinafter.

The four bit output from encoder circuit 18 is connected to the four D inputs of a D type latch 20. The clocking input to latch 20, as shown in FIG. 2, is connected to the output of the end of scan decoder 8 and is pulsed once after each multiplexing cycle as previously described.

The four outputs of latch 20 are connected as the four controlling inputs to a four line to one of sixteen line decoder 22. The control wire from selector switch 14 is connected to the enabling input of decoder 22. With selector switch 14 in the pattern position, as shown in FIG. 2, the enabling input of decoder 22 will be supplied with a logic zero signal, thus enabling the decoder. Each of the sixteen output lines of decoder 22 are connected to enable one line of the root of pattern read only memory 24.

Root of pattern read only memory 24 will develop a first six bit output indicated in FIG. 2 as the pattern root word, or reference word, and labeled K, and a second one bit output shown in FIG. 2 is connected to wire 47 and to the input of inverter 46. The K output of read only memory 24 is connected as a first input to ALU 26, shown in FIG. 4, and the second output of read only memory 24 on wire 47 is connected as a one line input to read only memory 40 as shown in FIG. 3, while the output of inverter 46 forms a second one line input to read only memory 40.

Referring to FIG. 3, the organ rhythm unit 34, as previously mentioned, supplies a first output line 28, with rhythm pulses, and a second output line 30 with a single pulse which occurs once after each rhythm measure; more specifically, after thirty-two pulses on line 28.

Output line 28 from rhythm unit 34 is connected as the clocking input to a pair of four bit binary counters, indicated in FIG. 3 by the dotted box marked 36, and interconnected to be used as a five bit binary counter. Output line 30 from rhythm unit 34 is connected to the clearing input of each of the counters indicated at 36. The five bit output from counter 36 is connected to the addressing inputs of a one-of-thirty-two decoder indicated at 38 and which consists of, for instance, two one-of-sixteen decoder chips **38*a* and 38*b***.

The least significant four bits from counter 36 are connected to the four addressing inputs of each of decoders **38*a* and 38*b*, while the most significant bit from counter 36 forms the enabling input to decoder 38*a* and is inverted as shown in FIG. 3 to form the enabling input to decoder 38*b***.

Each of the thirty-two output lines of decoder 38 are connected to enable a respective line of read only memory 40.

A third output from the organ rhythm unit 34 and indicated in FIG. 3 as line 32, consists of the $\frac{3}{4}$, four-fourth select. Line 32 is connected as the input to an invertor 70 and a first input to each of two AND gates 72 and 74. The second input of each of AND gates 72 and 74 is connected to one terminal of the pattern select switch 44. Line 32 will be at a logic one signal if the selected rhythm pulse train is four-fourth time, and at logic zero whenever the three-fourth rhythm train is selected. A logic zero signal on line 32 will enable the third section of read only memory 40 through invertor 70, while a logic one signal on line 32 will provide an enabling input to each of AND gates 72 and 74 while disabling the third section of read only memory 40 through invertor 70.

With a logic one signal on line 32, the pattern to be enabled will be selected by selector switch 44. With selector switch 44 in the position as shown in FIG. 3, the second input to AND gate 72 will be a logic one, thus enabling the output of AND gate 72 and thereby enabling the second portion of read only memory 40. With selector switch 44 in the second position, labeled pattern 3, the second input to AND gate 74 will be enabled, thus enabling the first portion of read only memory 40.

Once a line in read only memory 40 is enabled from decoder 38, and a section is enabled from pattern selector circuit 44, a six bit word will be developed at the output of read only memory 40; indicated in FIG. 3 at J; and a three bit output will be developed which forms the three bit input to a three input NOR gate 48. The output indicated at J in FIG. 3 forms the second six bit input to ALU 26 shown in FIG. 4, while the output of NOR gate 48 is inverted in inverters 50 and forms a two bit output indicated at L in FIG. 3 and which forms a two bit input to the ALU 26 shown in FIG. 4.

The input to ALU 26; indicated at K in FIG. 4; as previously mentioned, determines the location of the pattern reference note and remains constant so long as the same key on the accompaniment manual 12 is held depressed, while the input indicated at J in FIG. 4 corresponds to the difference for each succeeding note of the pattern from the reference note, that is, the number of notes of the scale separating each of the succeeding notes of the pattern from the original note.

For example, assuming that the pattern originated at an A note, and the second note in the pattern is to be the B key directly above that A key, the six bit word on the J input to ALU 26 will consist of the binary word for the number two, and the L input to ALU 26 will contain the logic to cause ALU 26 to add the J input to the K input thereto.

Similarly, each six bit word at the J input, as the different lines of read only memory 40 are enabled, will each consist of the binary word corresponding to the number of notes up, or down, the keyboard, each note in the pattern is from the initial note.

The inputs to ALU 26, indicated at L in FIG. 4, control the adding or subtracting function carried out by ALU 26, thus allowing the information in read only memory 40 to be either added to the word in read only memory 24 or subtracted from that word.

ALU 26 forms a single six bit output, indicated in FIG. 4 at Y1 through Y6, and which is connected to the D inputs of a six bit latch 52. Latch 52 is clocked once at the end of each multiplexing cycle from the end-of-scan circuit 8.

The Q outputs of latch 52 are connected as a first six bit input to the magnitude comparator 10, with the second six bit input connected to the outputs of the master clock 4 as previously described. When the two word inputs to the magnitude comparator 10 are identical, a positive pulse will be developed at the A=B output terminal, which is connected to a first input of NAND gate 56.

When any of the patterns control keys are depressed, the logic one signal at the NKD output of patterns encoder 18 will enable NAND gate 56; as indicated in FIG. 4; and a positive pulse occurring at the A=B output of magnitude comparator 10 will pulse the output of NAND gate 56 to a logic zero.

The output of NAND gate 56 is connected to one input of AND gate 58, and any logic zero signals occurring at the output of NAND gate 56 will cause the output of AND gate 58 to pulse also to logic zero, thus presenting a key down, or low, signal to demultiplexer 60.

Figure 5:
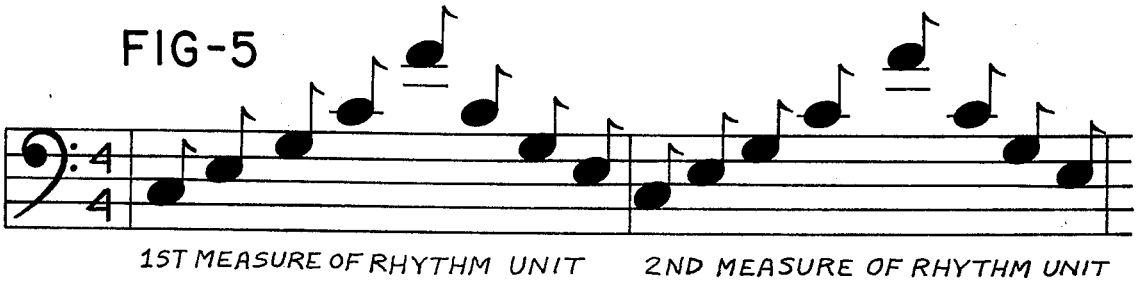
FIGS. 5 and 6 are drawings of note patterns.
Figure 6:
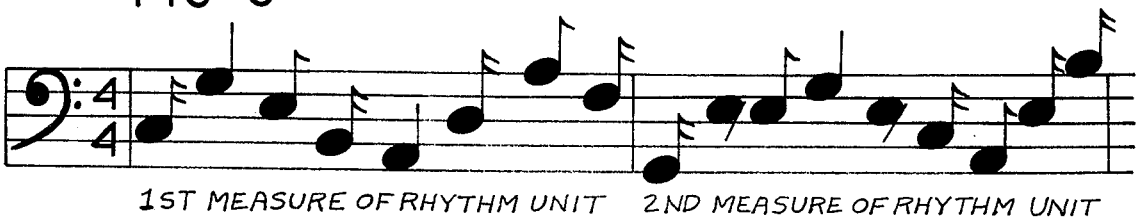

FIGS. 5 and 6 show two different note patterns, each consisting of two measures. The note patterns demonstrated in FIGS. 5 and 6 are two examples of note patterns which could be played using the circuit as just described with, for instance, the pattern of FIG. 5 programmed into the pattern one positions of patterns read only memory 40, while the pattern in FIG. 6 could be programmed into the pattern two of patterns read only memory 40.

Figure 7:
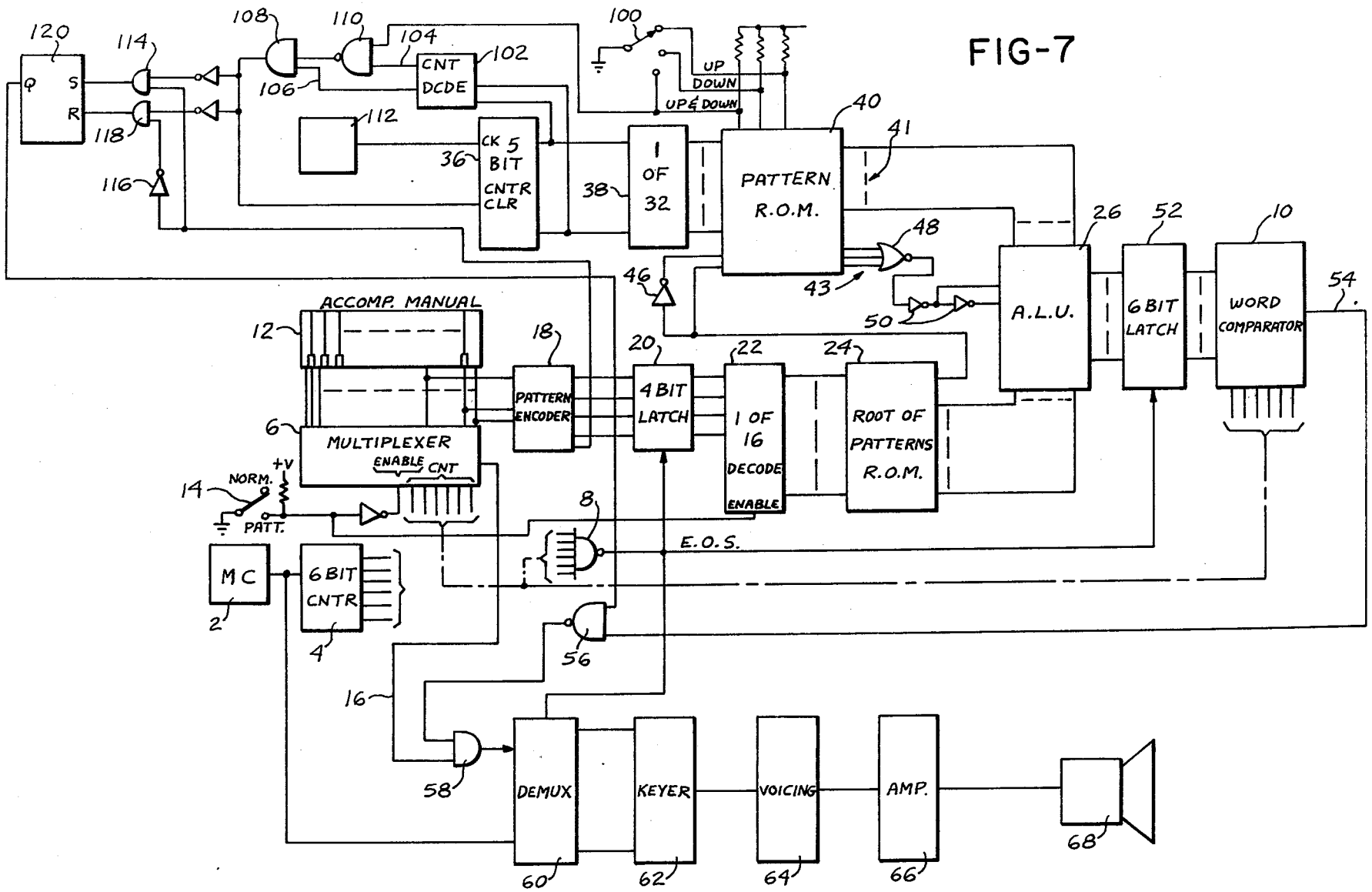
FIG. 7 is a simplified block diagram showing a modification of the present invention.

A first modification of the above described circuit is shown in FIG. 7. The modification is designed to enable the organist to simulate an arpeggio effect.

In operation, the circuit of the first modification will sound the notes of the chord, selected by depression of one of the chord playing keys, in succession to simulate the organist's rolling of the notes of the chord. The circuit herein described will repeatedly sound the notes of the chord in succession until the chord playing key is released. Once the chord playing key is released, the circuit will continue to operate until all the notes of the chord have been played.

The operation of the circuit in FIG. 7 is substantially the same as the operation of the circuit in FIG. 1, and each of the components in FIG. 7 which operates the same as in FIG. 1 is labeled the same as in FIG. 1. Only those components which are modified from the circuit of FIG. 1 are labeled with new numbers.

Briefly, the operation of the circuit shown in FIG. 7 is the same as that of FIG. 1 in that depression of one of the chord playing keys will cause a six bit binary word to be presented to a first input to arithmetic logic unit (ALU) 26, while a second binary word is connected to the second input to ALU 26. ALU 26 modifies the word connected to the first input thereto by combining (either adding, or subtracting) the binary word connected to the second input thereto with the word connected to the first input thereto and developing the so modified word to a six bit output. The six bit output of the ALU is then latched by latch 52 and used in word comparator 10 to develop a key down signal for insertion in the data stream as was previously discussed in connection with the circuit shown in FIG. 1.

The present modification involves the second read only memory (ROM) 40, and the manner in which ROM 40 is addressed.

Referring to FIG. 7, the three subsections of ROM 40 are enabled by the output of a selector switch 100 having three positions marked 'UP', 'DN', and 'UP and DN'. ROM 40 will operate, as before, developing a six bit binary word at the output thereof as each line of ROM 40 is successively enabled by decoder 38, with decoder 38 being addressed by counter 36.

The outputs of counter 36 are also connected to the input of a count decoder circuit 102. Circuit 102 will produce a negative pulse at a first output 104 whenever the output of counter 36 reaches count three, and a negative pulse at an output 106 whenever the output of counter 36 reaches count seven.

Output 104 of circuit 102 and the output of switch 100 from position 'UP and DN' through NAND gate 110 are connected to one input of an AND gate 108, the other input of which is connected to output 106 of counter 36. Output 104 of decoder 102 is disabled by NAND gate 110 whenever selector switch 100 is in either of the UP or DN positions thereof, or the output of AND gate 108 is connected to the clearing input of counter 36.

It will be seen from the above, that with selector switch 100 in either of the positions labeled 'UP', 'DN', counter 36 will count from zero to three repetitively as long as the clocking input is pulsed, while with selector switch 100 in the third position, labeled 'UP and DN', counter 36 will count from zero to seven repetitively. Counter 36 is clocked by the output of a clock 112, which is, conveniently, a one to ten hertz clock.

The key down output of encoder circuit 18 is connected to a first input of an AND gate 114 and is inverted by inverter 116 and connected to a first input of AND gate 118. The second input of each of AND gates 114 and 118 is connected via a respective inverter to the output of AND gate 108. The outputs of AND gates 114 and 118 are connected to the S and R inputs of an S-R flip flop 120, with the Q output of flip flop 120 connected to the enabling input of NAND gate 56.

The output of flip flop 120 will switch to logic 1 the first time counter 36 is reset to count zero after one of the chord playing keys of manual 12 are depressed, and will remain at logic 1 until the first time counter 36 is reset to count zero after the key of manual 12 is released. Flip flop 120 thus allows the chord playing key of manual 12 to be tapped and released without interrupting the sounding of the full set of notes of the selected chord.

With the circuit as described above in operation, the output of ROM's 24 and 40 will cause ALU 26 to develop a series of binary words at the output thereof, and the words produced by ALU 26 will cause a series of notes to sound in succession in response to depression of one of the chord playing, or pattern control, keys of manual 12.

In the foregoing description, certain specific arrangements have been illustrated and described, but it will be understood that what is shown in the application is merely exemplary in that the system of the present invention is extremely flexible and is adapted for being practiced with many variations.

For example, single note patterns have been illustrated, but it will be apparent that two or more notes could be played on each pulse merely by arranging further note sources in parallel for simultaneous actuation by the system.

The arrangement illustrated is highly flexible and forms an easy to play feature. According to the present invention, an essential central feature is that of detecting the depression of a playing key when developing a signal therefrom and employing the thus developed control signal to actuate keyers according to predetermined patterns.

In the disclosure, a conventional rhythm unit has been illustrated as a source of pulses for operating the keyers, but any sort of time dependent or time varying source of command signals, such as a repeat oscillator, can be employed.

It will also be evident that the present invention is not limited to use with any particular portion of the organ, such as the silo or accompaniment or pedal keyboards, but can be employed with any one or more thereof and can be used in such a manner as to permit cross coupling wherein, for example, accompaniment manual keys would actuate solo manual keyers.

The signal source under the control of the keyers is also not limited to the signal sources employed for producing tones when individual keys are depressed. Thus, what can be referred to as non-keyboard notes or tones can be provided for, and these notes or tones are only played when the system according to the present invention is effective. Such non-keyboard notes or tones could also include special percussion effects and the like not normally available in organ voicing arrangements.

The above disclosure has been based primarily on a set of fifteen chords and has taken into account the possibility of major and minor chords only.

The following three modifications increase the range of the chords making up the chord set by providing the capability to detect, and alter a note pattern, according to any of major, minor, or diminished chords.

Figure 8:
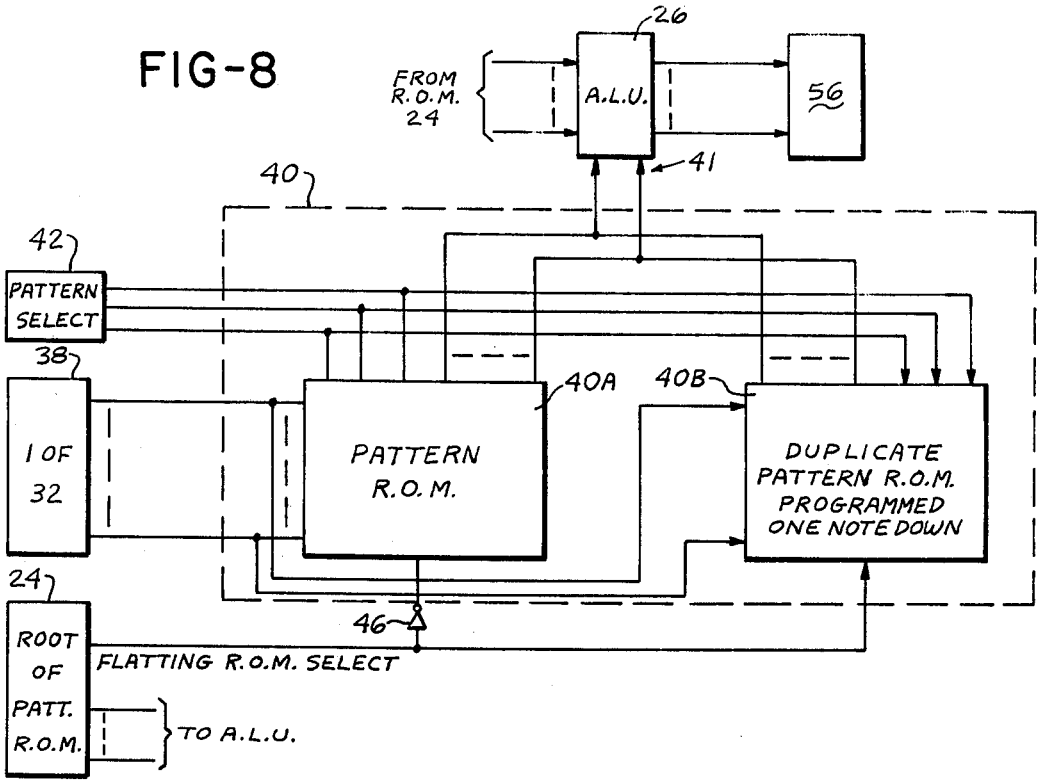
FIGS. 8, 9 and 10 are block diagrams of portions of the circuit of the present invention, showing modifications thereof.

Referring to FIG. 8, there is shown the read only memory 40, previously referred to, and a portion of the surrounding circuitry. Read only memory 40 is shown within a dotted line, and consists of a pair of read only memory sections 40*a* and 40*b*, labeled in FIG. 8 as pattern ROM, and duplicate pattern ROM, respectively.

It will be noted that the inputs from the pattern selector circuit 42, the one of thirty-two decoder 38 and root of patterns ROM 24 are the same inputs as has been discussed earlier in this disclosure.

The modification shown in FIG. 8 consists of having pattern ROM 40*a* and pattern ROM 40*b* programmed one note apart. More specifically, pattern ROM 40*a* will be programmed as previously discussed in reference to pattern ROM 40 above, while duplicate pattern ROM 40*b* will be programmed with each word therein one count lower than pattern ROM 40*a*. The one bit output from root of patterns ROM 24 connected to inverter 46 and as an input to patterns ROM 40, as shown in FIG. 1 and in FIG. 8, will now perform the function of selecting one of patterns ROM 40*a* or 40*b*. The selected patterns ROM will then develop a six bit word at the corresponding output which are interconnected to form output number 41, which is then connected as the second six bit input to arithmetic logic unit 26.

Figure 9:
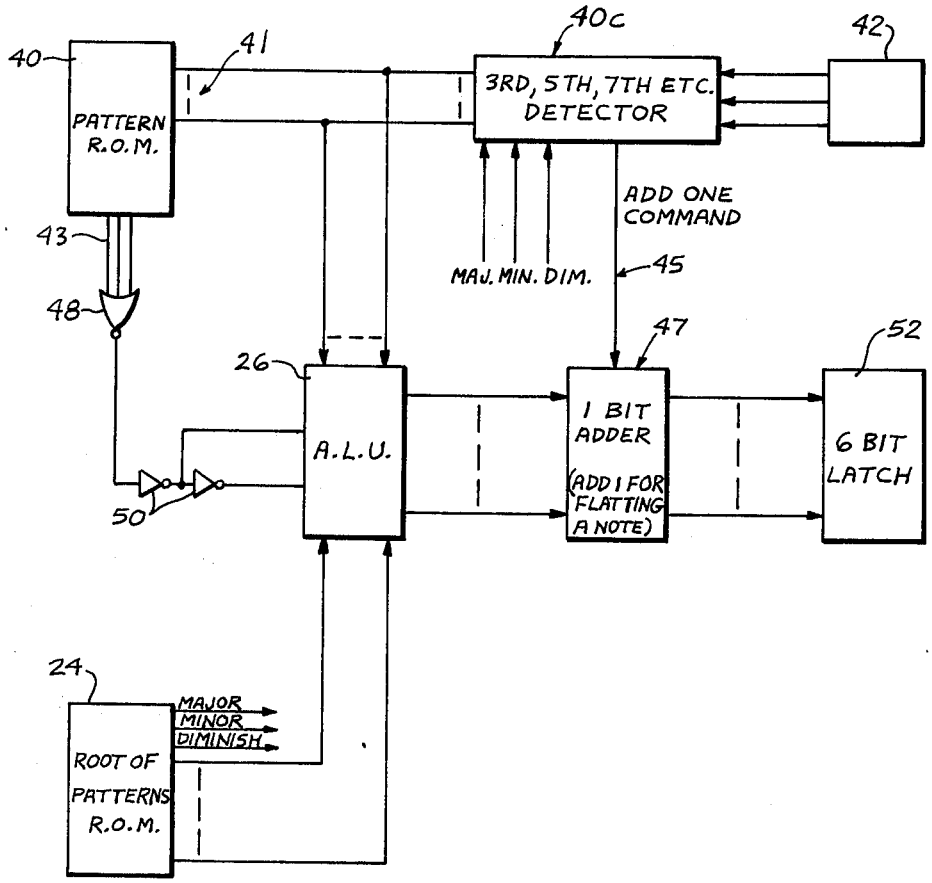

In FIG. 9, other methods of modifying the note pattern is shown. In FIG. 9, patterns ROM 40, root of patterns ROM 24, arithmetic logic unit 26, and a six bit latch 52 operate in the same fashion as these units disclosed earlier in the disclosure. In addition to these units, however, an additional read only memory 40*c*, labeled the third, fifth, and seventh detector, is shown connected to the output of patterns ROM 40. Additional inputs to read only memory 40*c* are the pattern control inputs from pattern select circuit 42 and three inputs labeled MAJ, MIN, and DIM. These inputs are derived by providing an additional three bit output to the root of patterns ROM 24.

In operation, the third, fifth, and seventh detector circuit 42 will provide an output on wire 45 whenever either a minor chord or a diminished chord is being played and the output word 41 from patterns ROM 40 corresponds to, for instance, the third or fifth note. The output signal on line 45 is connected to enable a one bit adder circuit 47.

The operation of circuit 47 is such that the signal on line 45 is added to the output of arithmetic logic unit 26. When detector circuit 40*c* provides an output on line 45 a 'one' will be added to the output of arithmetic logic unit 26, thus flatting the note. When an output is not provided to line 45 the output of ALU 26 will be transferred without modification to the output of circuit 47, which, as can be seen in FIG. 9, is connected to the input of latch 52, hereinbefore discussed.

The modification disclosed in FIG. 9 thus allows for selective flatting of individual notes in a pattern depending on the type chord which is being played in the accompaniment manual.

Figure 10:
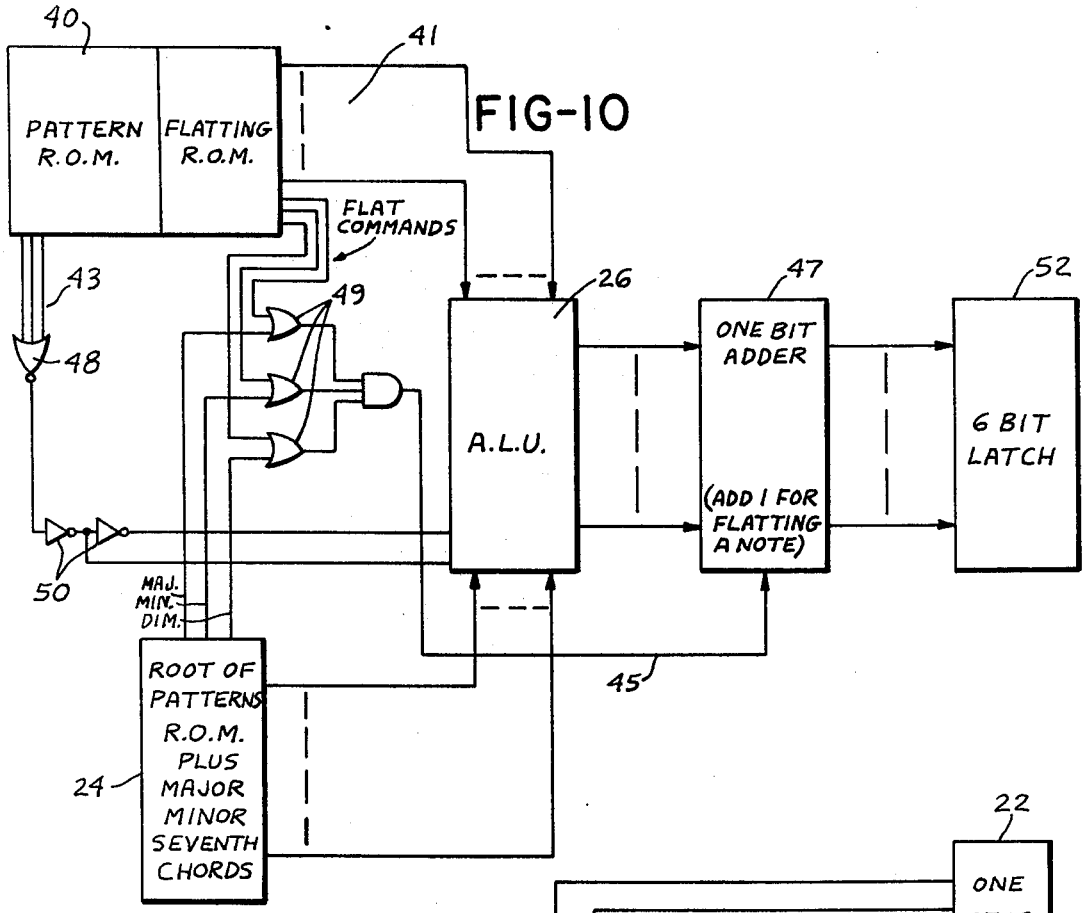

Referring to FIG. 10, an additional method of providing selective flatting is shown. In this modification, instead of providing a second read only memory 40*c*, patterns ROM 40 is simply expanded to provide an additional three bit output, labeled in FIG. 10 as 'flat commands'. These commands are connected to a first input of each of three OR gates 49, with the second input of each of these OR gates connected to the major, minor, and diminished outputs from patterns ROM 24. The outputs of OR gates 49 are 'anded' together to provide the output for wire 45 which is connected as the control input to the one bit adder 47.

The circuit in FIG. 10 essentially provides the same flexibility as discussed in reference to the modification in FIG. 9.

It should be pointed out that the circuit of the present invention can be added to organs which do not use multiplexing, as generally discussed in this disclosure.

The four modifications, shown in FIGS. 11 through 14, are essentially interface modifications allowing the circuit of the present invention to be used with virtually any electronic organ, including those not having multiplexing.

Figure 11:
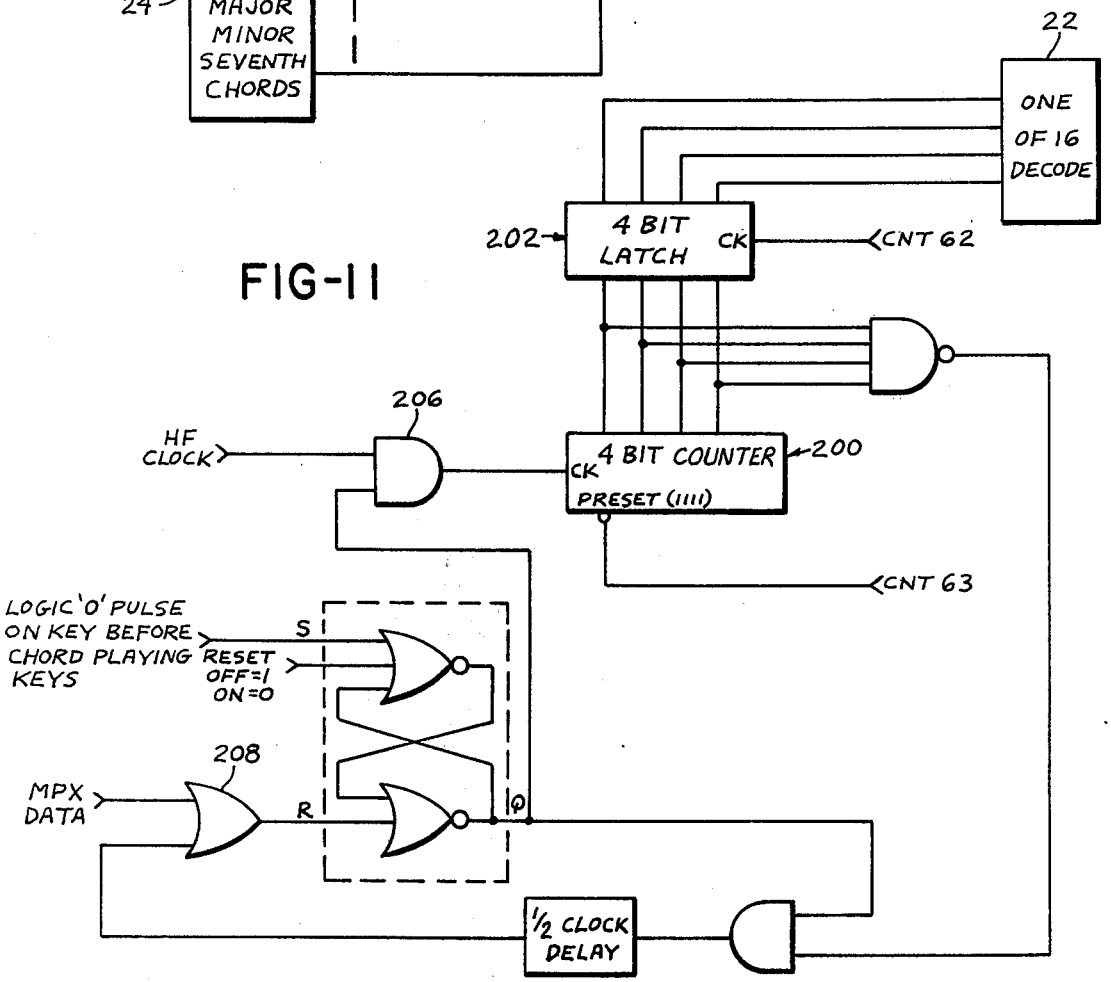
FIG. 11 is a schematic drawing of an alternate method of interfacing an organ with the circuit of the present invention.

In FIG. 11, an alternate method of producing the four bit chord word is shown. The circuit of FIG. 11 consists of a four bit counter 200, a four bit latch 202 and a flip flop 204. Flip flop 204 consists of a pair of NOR gates connected to form a set-reset flip flop. This circuit is intended for use with multiplex organs in which the method shown in FIG. 2 for developing the four bit chord word is unsuitable.

The operation consists of enabling counter 200 to count during the time that the organ multiplexing unit is scanning the chord playing keys of the accompaniment manual, and counting the number of nondepressed chord playing keys until the first depressed one of the chord playing keys is reached. This is accomplished by setting flip flop 204 during the time when the multiplexing unit is scanning the key on the keyboard just above the first of the chord playing keys. The organ count decoding circuit is enabled for providing a logic 0 pulse during that time period, and which pulse is connected as one input to RS flip flop 204. The pulse during this time period will set flip flop 204 and cause the output thereof to become a logic 1. The logic 1 at the output of flip flop 204 is connected as a first input to an AND gate 206. AND gate 206 will pass clock pulses from the organ multiplexing clock to the clocking input of counter 200 whenever the output of flip flop 204 is at logic 1.

The resetting input to flip flop 204 is connected to the output of an OR gate 208 which will pulse to logic 0 whenever a keydown signal is developed by the accompaniment manual multiplexer; that is, whenever a depressed chord playing key is encountered by the multiplexer. The pulse from OR gate 208 will reset flip flop 204, and disable AND gate 206 for passing clock pulses.

Flip flop 204 will remain in reset condition until the next keyboard scan. During counts sixty-two and sixty-three of the keyboard scan, the four bit latch 202 is clocked on count sixty-two and the four bit counter 200 is reset during count sixty-three. Thus, at the end of each keyboard scan, the output of latch 202 will correspond to the depressed one of the chord playing keys of the accompaniment manual.

The output of latch 202 is then connected as the four bit input to decoder 22. The circuit of FIG. 11 can then be seen to be a direct replacement for the pattern encoder circuit 18 and the four bit latch 20 previously described in this disclosure for producing the four bit chord word.

Similarly, the output of the circuit of the present invention can be interfaced easily with organs not employing the multiplexing arrangements herein described.

Figure 12:
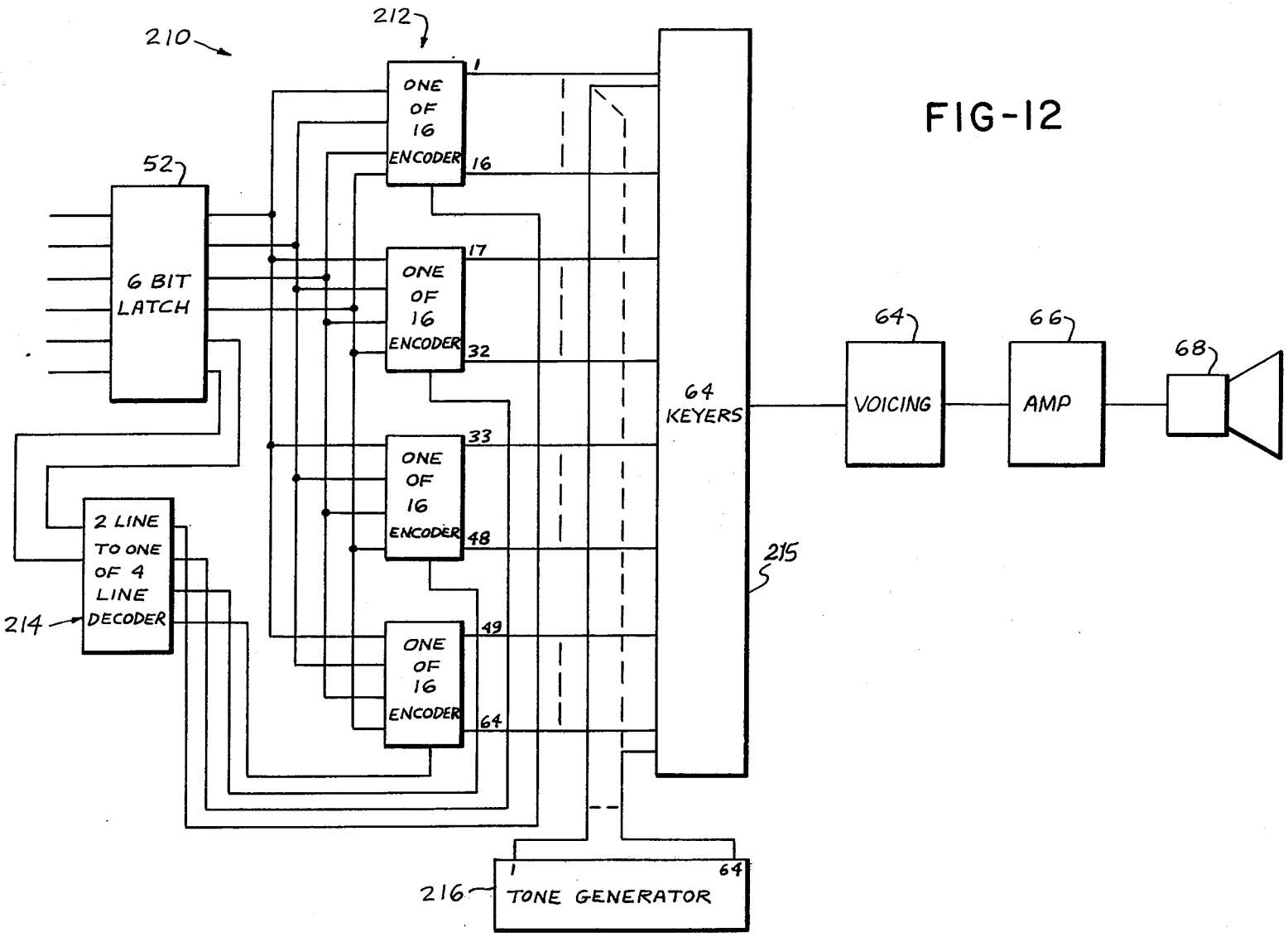
FIG. 12 is a schematic drawing of an alternate method of interfacing an organ with the circuit of the present invention.

The circuit of FIG. 12 demonstrates one possible method for such interfacing. In FIG. 12, the six bit output of latch 52 is connected to the input of the one of sixty-four decoding circuit, generally indicated at 210. Circuit 210 consists of four one of sixteen decoders 212 and one two line to one of four line decoder 214. The four least significant bits of the outputs of latch 52 are connected to the four control inputs to each of decoders 212, while the most significant bits of latch 52 are connected to the two line control input to decoder 214.

The outputs of decoder 214 are then connected to the enabling inputs of each of decoders 212. With this arrangement, a single one of the sixty-four output lines, made up of the four groups of sixteen outputs each of decoders 212, will be enabled for each six bit output from latch 52. The sixty-four outputs from latches 212 are then connected to the control inputs to each of sixty-four keyers 215. A tone generator 216, providing sixty-four tones, is connected to the signal inputs of the sixty-four keyers 215. In this manner, a six bit word at the output of latch 52 is enabled to pass one of sixty-four tones from tone generator 216 to the voicing circuits 64, amplifier circuit 66, and speaker 68.

Figure 13:
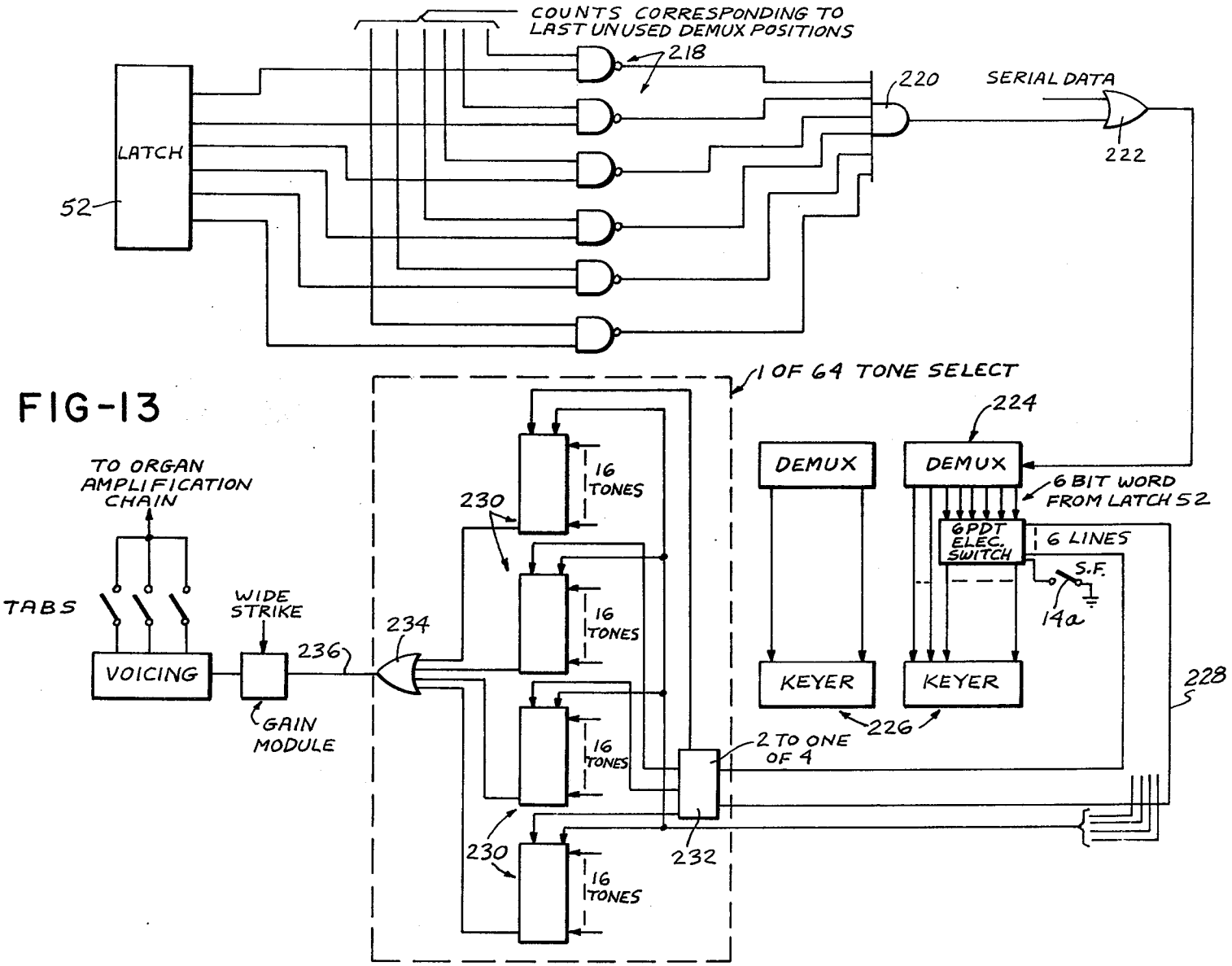
FIGS. 13 and 14 are schematic drawings showing alternate methods of processing outputs of the circuit of the present invention.

FIG. 13 shows a modification in which one of sixty-four tones are selected in a manner similar to that described in FIG. 12, but in which data corresponding to the six bit word from latch 52 is transferred through the serial data stream and the demultiplexed latch circuit to the tone selecting circuit.

The outputs of latch 52 are connected to the first input to each of six NAND gates 218. The outputs of NAND gates 218 are then connected to each of the six inputs of a six input AND gate 220, with the output of AND gate 220 orred in OR gate 222 with the serial data stream from the keyboard multiplexer.

The second inputs to NAND gates 218 are sequentially enabled during successive key scan periods during the keyboard multiplexing cycle. The sequential enabling of NAND gate 218 is accomplished by decoding each of six sequential time slots during the keyboard scan, such as count fifty-five through count sixty. The sequential enabling of NAND gates 218 thus provide a method for converting the six bit output of latch 52 into a serial six bit word, which is transmitted over the data stream line through OR gate 222 to the demultiplex latch circuit 224 of a standard organ. If counts fifty-five through counts sixty have been selected, as hypothesized, the six bit word from latch 52 will be transferred to the last six bits of the demultiplexed latch 224, as shown in FIG. 13.

An electronic switch receives the six bits of the output of latch 224. This switch will transmit the six bits from latch 224 through to the keyer circuit 226 whenever the rhythmic pattern circuit switch 14*a* is switched OFF and will transfer the six bits from latch 224 to a six line output 228 whenever the rhythmic pattern circuit switch 14*a* is switched ON. The six bits at output 228 are then connected to the input of one of sixty-four line decoding circuit 230. The four least significant bits of the six bit output 228 will be connected to the four addressing inputs to each of four one of sixteen selector circuits, such as the industry standard type N. 74150 integrated circuit chip. The two most significant bits of output 228 will be connected to a two line to one or four line decoder 232. Decoder circuit 232 will enable one of the four one of sixteen selector circuits 230 for each word on the two most significant bits of output 228.

The sixteen inputs to each of selector circuits 230 comes from a sixty-four tone generator 216, described in FIG. 12. Each output of the four selector circuits 230 are orred together in OR gate 234 to provide a single output on line 236.

Figure 14:
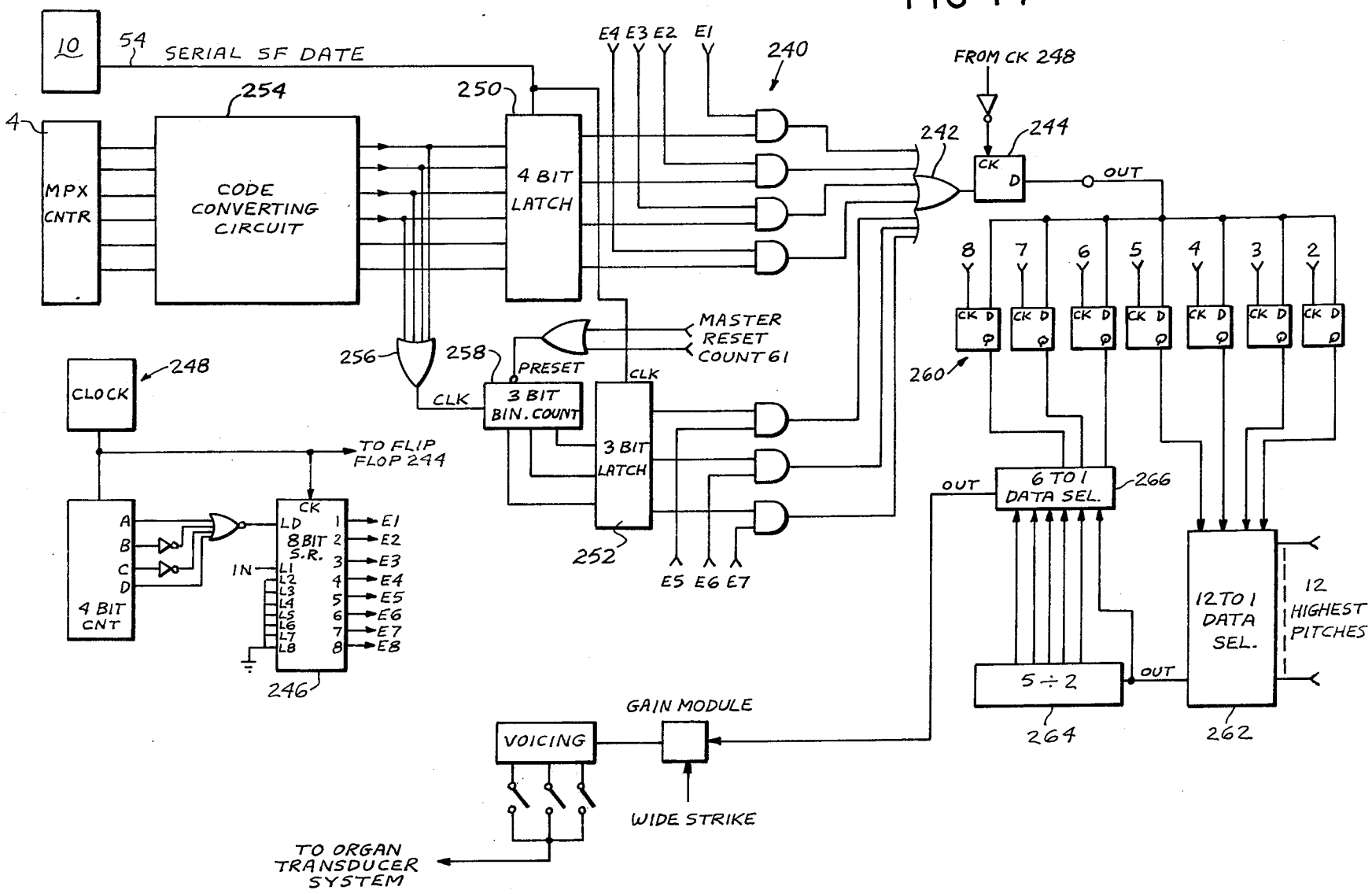

Finally, the circuit shown in FIG. 14 is an additional method for selecting one of sixty-four tones without using an organ demultiplexing circuit. The circuit operates similarly to the circuit in FIG. 13, with a group of AND gates 240 sequentially enabled by inputs labeled E1 through E7 in FIG. 14. The outputs of AND gates 240 are combined in an OR gate 242 and form a D input to flip flop 244. The E1 through E7 inputs are derived from a shift register 246 which is clocked by the output of a clock 248. The output of clock 248 is also connected through an inverter to flop flop 244.

Flip flop 244 is an edge triggered flip flop and will thus provide a one-half clock period delay between the output of OR gate 242 and the Q output of flip flop 244. The second input to each of AND gates 240 is connected to the output of a four bit latch 250 and a three bit latch 252. The input to four bit latch 250 is a four bit binary code word from a code converting circuit 254. Converter circuit 254 will convert the six bit count at the output of multiplex counter 4 to a repeating four bit, 0 to 11 count, during the multiplexing cycle. This count repeats 0 to 11 five times, and then maintains a count sixteen output during multiplexer counts sixty-two and sixty-three.

The counts 0 to 11, of course, coincide with the multiplexing of each octave on the organ keyboard, and, therefore, the counts at the output of decode converter correspond to the respective keys being scanned. That is, count zero will be developed at the output of the code converter for each time the keyboard multiplexer is scanning, for instance, a C key.

The outputs of the code converter are also connected to the inputs of an OR gate 256. OR gate 256 will, thus, provide a logic zero pulse to the clocking input of a three bit counter 258 for each zero to eleven cycle developed at the output of code converter 254. The four bit output of latch 250 and the three bit output at latch 252 thus correspond to a four bit word for pitch and a three bit word for the octave which uniquely defines one note on a sixty-three note keyboard.

The clocking inputs to latch 252 and 250 are connected to the serial data output line 54 from word comparator 10. Thus, the serial data output will clock latch 250 and 252 and thus determine which of the pitches is controlled by the outputs of latches 250 and 252.

As the outputs of shift register 246 shifts from E1 through E8 repetitively, the output of latches 250 and 252 are converted to a serial format by OR gate 242 and flip flop 244. This serial data is reconverted to a six bit word by a group of D type flip flops 260 having the clocking inputs connected to the outputs of shift register 246, labeled E2 through E8. As each bit at the output of latch 250 and 252 is transferred through OR gate 242 to the output of flip flops 244 it is latched into a corresponding one of flip flops 260. The one-half clock cycle delay provided by flip flop 244 allows the edge triggering of each of the flip flops 260 by the next output of shift register 246 for proper transfer of the seven bit word contained in latches 250 and 252 to the outputs of flip flop 260.

The first four of latches 260 are connected as addressing inputs to a twelve line to one line data selector 262. The twelve data inputs to data selector 262 correspond to the frequencies of the highest twelve notes of the organ keyboard. The output of selector 262 is connected to the input of a five stage divider 264, to divide the pitch selected by selector 262 into frequencies corresponding to each of the octaves on the organ keyboard. The five outputs of divider train 264 and the output of selector 262 are connected to a six line to one line data selector 266. The remaining three outputs of flip flops 260 are connected as the addressing inputs to the six line to one line data selector 266, and will select the output of divider train 264 corresponding to the octave selected by the output of latch 252. The output of data selector 266 is then connected via a gain control circuit to a voicing circuit for shaping.

It will be seen that the modifications as discussed in reference to FIGS. 8 to 14 add a flexibility to the circuit of the present invention by providing a means for using the invention in a wide variety of electronic organs, including substantially all types of organs encounted in the filed.

It will be appreciated that the term "binary" as used herein is not limited to a base ten number system but could refer to an octal system or to any other number base. The term 'binary' refers to a system which handles information in the form of 'bits', or 'data items', having two discernable states, for example, high or low.

While 'major' and 'minor' chords have been referred to herein, it will be apparent that any chord type, such as dimished, sixth, seventh, and the like can be programmed and selected.

The term 'root word' is used herein because many patterns start on a root note but it will be understood that this term refers to a reference position in the keyboard and is thus the same as the term 'reference word', also employed herein.

Modifications may be made within the scope of the appended claims.

What is claimed is:

1. The method of playing notes in a selected rhythmic pattern in an electronic organ having sound signal generator means, transducer means and keyers connecting the generator means with the transducer means, said organ having playing keys and multiplexing means for scanning said playing keys sequentially and including a counter driven by a high frequency clock and having a binary word output, said organ also having demultiplexer means responsive to binary data supplied thereto for actuating said keyers and synchronized with said multiplexer means, said method comprising: developing a respective first binary word in conformity with the depression of each of at least some of said playing keys forming pattern control kys, developing a first series of binary words in succession according to a selected rhythmic pattern and substantially slower than the frequency of the multiplexer clock, sequentially combining said first binary word with each word of said first series of binary words to develop a second series of binary words, comparing each word of said second series of binary words with the binary word output of said counter, and supplying a pulse to said demultiplexer means each time the compared words are equal.

2. The method according to claim 1 which includes developing a respective first control signal for each pattern control key which is depressed, and developing a respective said first binary word for each first control signal.

3. The method according to claim 1 which includes scanning said playing keys repetitively and in the same direction on each scan and with one and the same binary word from the counter corresponding to the same playing key on each scan.

4. The method according to claim 1 which includes supplying a respective encoded signal for each pattern control key which is depressed, developing a respective first control signal for each encoded signal, storing the encoded signal, and updating the stored signal following each scan of the playing keys and prior to the initiation of the next following scan.

5. The method according to claim 1 which includes storing each word of said second series of words when the respective word is developed and supplying the thus stored word for comparison with the output of the multiplexer counter, and updating the stored word following each scan of the playing keys and prior to the initiation of the next following scan.

6. The method according to claim 1 in which each playing key corresponds to a respective chord and the first word of said first series pertaining to each playing key is selected so the first word of the second series will correspond to the multiplexer clock count for the time slot pertaining to the keyer for the root note of said chord.

7. The method according to claim 1 which includes storing binary words for forming a plurality of said first series of binary words, selecting predetermined ones of said words on successive counts of the selected rhythm pattern to form a said first series of binary words while simultaneously selecting one of add and subtract commands, and effecting the combination of the first binary word with the words of said first series of binary words in conformity with the respective one of said add and subtract commands.

8. The method according to claim 7 which includes developing a command signal corresponding to a chord type for each pattern control playing key which is depressed, and enabling respective groups of said stored words for selection on respective rhythm counts in conformity with the developed command signal.

9. The method according to claim 7 which includes selecting a predetermined first series of binary words for each rhythmic pattern selected.

10. In an electronic organ having sound signal generator means, transducer means and keyers connecting the generator means with the transducer means, playing keys, multiplexer means for scanning the playing keys sequentially and including a counter driven by a high frequency clock and having a binary word output, demultiplexer means responsive to binary data supplied thereto for actuating the keyers, said demultiplexer means being synchronized with the multiplexer means, and first circuit means for connecting the output of the multiplexer means to the demultiplexer means for the actuation of keyers in correspondence to the playing keys depressed, the improvement being circuitry for producing rhythmic note patterns comprising: second circuit means for developing a respective first binary word in conformity with the depression of a key of a group of said playing keys forming pattern control keys, third circuit means for developing a first series of binary words in succession according to a selected rhythmic pattern at a rate substantially lower than the frequency of said high freuqency clock, fourth circuit means for sequentially combining said first binary word with each word of said first series of binary words to develop a second series of binary words, and comparator means for comparing each word of said second series of binary words with the output of said counter and supplying a pulse to said demultiplexer means each time the compared words are equal.

11. An electronic organ according to claim 10 in which said counter develops a respective binary word at its outputs for each playing key scanned, and means for initiating each scan at one and the same end of the playing keys and on the same count.

12. In an electronic organ having sound signal generator means, transducer means and keyers connecting the generator means with the transducer means, playing keys, multiplexer means for scanning said playing keys sequentially and including a counter driven by a high frequency clock and having a binary word output, demultiplexer means synchronized with said multiplexer means responsive to binary data supplied thereto for actuating said keyers, and first circuit means for connecting the output of said multiplexer means to said demultiplexer means for the actuation of keyers in correspondence to the playing keys depressed, the improvement being circuitry for producing rhythmic note patterns comprising: means for generating a respective first binary word in response to the depression of each pattern control key, first memory means having a plurality of binary words stored therein and having addressing inputs and outputs, means for addressing said inputs for generating a first series of binary words sequentially according to a predetermined rhythmic pattern at said outputs, logic unit means connected to receive said first word as a first input and the words of said first series as a second input and having an output at which one of the sum and difference of said input words appears, a word comparator connected to receive the word at the output of said logic unit as one input and the words supplied by the multiplexer counter as a second input and having an output at which a pulse appears when the input words are equal, means for supplying said pulse to said demultiplexer, and selector means for selectively enabling said circuitry for producing rhythmic note patterns and at the same time disabling said first circuit means.

13. An electronic organ according to claim 12 in which said first memory means includes means to develop a respective one of add and subtract commands for each word of each first series supplied by said first memory means, and means for supplying the said one of said add and subtract commands to said logic unit means so each word of the respective first series is arithmetically combined with the respective first word in said logic unit means in conformity with the said command.

14. An electronic organ according to claim 13 in which said first memory means comprises a plurality of sections, said source of pulses including pattern selector means to select the pattern in which the pulses are supplied, and means operated by said pattern selector means to enable respective ones of said sections of said first memory means.

15. An electronic organ according to claim 12 which includes an encoder connected to receive signals from said pattern control keys, a decoder connected to be supplied by the encoder and developing a respective control signal for each pattern control key which is depressed, and second memory means storing a plurality of said first words and connected to be addressed by said control signals, said second memory means having output means connected to said logic unit means and at which outputs a respective first word is developed for each control signal supplied as an addressing input to said second memory means.

16. An electronic organ according to claim 15 in which said second memory means includes means for developing a respective one of major and minor commands for each control signal supplied thereto, and means for supplying said commands to said first memory means for enabling respective portions of said first memory means for each said command.

17. An electronic organ according to claim 12 which includes a latch connected to receive the output from said logic unit means and to supply the output to said comparator, said latch having a clocking input, and means for supplying a clocking signal to said clocking input at the end of each scan of said playing keys.

18. In an electronic organ: tone generator means, transducer means and interposed keyers, a keyboard having playing keys with a predetermined group thereof forming pattern control keys, multiplexer means for scanning said keyboard and demultiplexer means for actuating said keyers in conformity with pulses supplied thereof, said multiplexer means including a clock driven binary counter, a pulse source for developing repetitive rhythmic pulse patterns, a first memory actuated by pulses from said pulse source and operable repetitively to develop a first series of binary words, a second memory actuated by said pattern control keys and operable to develop a first binary word for each pattern control key depressed, means for effecting one of the addition and subtraction of each of said first series of words and said first word to develop a second series of binary words, comparing each of said second series of words with the count from said counter and generating a pulse when the compared words are equal, and means for supplying said pulse to said demultiplexer in the time slot corresponding to the respective count.

19. In an electronic organ having sound signal generator means, transducer means and keyers connecting the generator means with the transducer means, playing keys, multiplexer means for scanning the playing keys sequentially and including a counter driven by a high frequency clock and having a binary output, demultiplexer means responsive to binary data supplied thereto for actuating the keyers, said demultiplexer means being synchronized with the multiplexer means, and first circuit means for connecting the output of the multiplexer means to the demultiplexer means for the actuation of keyers in correspondence to the playing keys depressed, the improvement being circuitry for producing rhythmic note patterns comprising: second circuit means for developing a respective first binary word in conformity with the depression of a key of a group of said playing keys forming pattern control keys, third circuit means for developing a first series of binary words in succession according to a selected rhythmic pattern at a rate substantially lower than the frequency of said high frequency clock, fourth circuit means for sequentially effecting one of the operation of addition or subtraction of each of said first series of binary words on said first binary word to develop a second series of binary words, and fifth circuit means for supplying pulses to said demultiplexer means for actuation thereof according to the selected rhythmic pattern.

* * * * *